US006227537B1

(12) United States Patent
Schmid

(10) Patent No.: US 6,227,537 B1
(45) Date of Patent: May 8, 2001

(54) SERVICE WALKWAY FOR SHEET-STACKING APPARATUS

(75) Inventor: Frank Schmid, Krefeld (DE)

(73) Assignee: Jagenberg Papiertechnik GmbH, Neuss (DE)

( * ) Notice: Subject to any disclaimer, the term of this patent is extended or adjusted under 35 U.S.C. 154(b) by 0 days.

(21) Appl. No.: 09/256,926

(22) Filed: Feb. 24, 1999

(30) Foreign Application Priority Data

Feb. 26, 1998 (DE) ..... 198 07 855

(51) Int. Cl.[7] ..... B65H 31/10

(52) U.S. Cl. ..... 271/217; 271/214; 271/215; 182/143; 182/144

(58) Field of Search ..... 271/217, 218, 271/219, 214, 215, 207, 147; 182/141, 142, 143, 144, 36, 37; 414/790.4

(56) References Cited

U.S. PATENT DOCUMENTS

| | | | | |
|---|---|---|---|---|
| 1,560,470 | * | 11/1925 | Hitchcock | 271/147 |
| 4,108,061 | * | 8/1978 | Bowser | 100/7 |
| 4,191,368 | * | 3/1980 | Brookhyser | 271/10.01 |
| 4,324,397 | | 4/1982 | Byrt . | |
| 4,536,119 | * | 8/1985 | Miaskoff | 414/794.2 |
| 4,717,142 | * | 1/1988 | Saito et al. | 271/217 |
| 4,787,111 | * | 11/1988 | Pacek et al. | 14/71.1 |
| 5,299,653 | * | 4/1994 | Nebel | 182/2.7 |
| 5,628,505 | | 5/1997 | Voss . | |
| 5,685,392 | * | 11/1997 | Phillips et al. | 182/131 |

FOREIGN PATENT DOCUMENTS

| | | | | |
|---|---|---|---|---|
| 26 33 897 | | 2/1977 | (DE) . | |
| 2061886 | * | 5/1981 | (GB) | 271/217 |

* cited by examiner

*Primary Examiner*—Donald P. Walsh
*Assistant Examiner*—Daniel K Schlak
(74) *Attorney, Agent, or Firm*—Herbert Dubno; Andrew Wilford

(57) ABSTRACT

An apparatus for stacking sheets has a frame defining a stacking station, a conveyor for delivering the sheets continuously one after the other at a predetermined upper level in a transport direction to the station, a platform vertically displaceable in the stacking station between the upper level and the lower level, and a drive for displacing the platform vertically. Stops are provided on the frame at an intermediate level below the upper level, above the lower level, and slightly above a stack of maximum height supported on the platform with the platform at the lower level. A walkway is vertically displaceable on the frame immediately downstream of the stacking station between an upper position generally at the upper level and a lower position at the intermediate level. The platform is engageable underneath the walkway for raising the walkway from the intermediate level to the upper level on movement of the platform upward past the intermediate level to the upper level.

8 Claims, 2 Drawing Sheets

SERVICE WALKWAY FOR SHEET-STACKING APPARATUS

FIELD OF THE INVENTION

The present invention relates to a sheet-stacking apparatus. More particularly this invention concerns a service walkway for such an apparatus.

BACKGROUND OF THE INVENTION

In a paper mill a continuous strip of paper moving longitudinally at high speed must be transversely cut into individual sheets that must then be piled in individual stacks on pallets or the like. The stacking must be done without interrupting the flow of continuously arriving sheets, so that when a stack is complete it is necessary to get it out of the way and bring a new pallet into place while somehow catching and holding the sheets that arrive during the changeover.

Commonly owned U.S. Pat. No. 5,628,595 describes an apparatus having a downstream end spaced upstream in a horizontal longitudinal transport direction from a stacking station for delivering the sheets continuously one after the other at a predetermined upper level in the direction to the station and a main platform vertically displaceable in the stacking station between an upper position below the upper level and a lower position. An auxiliary platform below the upper level is formed by a plurality of parallel rods horizontally displaceable in the direction between an extended position in the station above the main platform and a retracted position upstream of the main platform. This platform is supported in a frame in each of its corners that has a post provided with a lift cable.

Such an apparatus can be very large, producing a stack some 3 m high and weighing several tons. Thus the upper level at which the sheets are fed in is at least 3 m above the floor. In order that service personnel can work on the equipment, for instance to reset it for different sheet sizes, clear a jam, or just perform regular maintenance, it is therefore standard to provide a service walkway or catwalk that is U-shaped, having a pair of longitudinal portions extending horizontally on either side of the stacking station parallel to the longitudinal feed direction and a transverse portion extending between their downstream ends. To work on the apparatus when it is set up for stacking short sheets, another fixed transverse walkway can be provided between the two downstream posts of the machine frame.

U.S. Pat. No. 4,324,397 describes such a machine where an operator platform is provided immediately downstream of the so-called backboard against which the sheets are projected as they are stacked. This platform can move horizontally with the backboard so that the operator is always ideally positioned to observe the stacking operation. While this system is useful for a person actually operating the machine, it does not provide the desired access for most of the repair and maintenance work that must be performed on the stacker.

German patent document 2,633,897 of E. Webb et al (claiming a British priority of Aug. 5, 1975) describes another such operator station in stacking machine. It also does not serve as a platform from which other maintenance or repair jobs can be done.

OBJECTS OF THE INVENTION

It is therefore an object of the present invention to provide an improved stacking apparatus.

Another object is the provision of such an improved stacking apparatus which overcomes the above-given disadvantages, that is which has an improved service walkway from which all the various service, resetting, and maintenance jobs can be done, regardless of what format the machine is set to work with.

SUMMARY OF THE INVENTION

An apparatus for stacking sheets has according to the invention a frame defining a stacking station, a conveyor for delivering the sheets continuously one after the other at a predetermined upper level in a transport direction to the station, a platform vertically displaceable in the stacking station between the upper level and the lower level, and a drive for displacing the platform vertically. Stops are provided on the frame at an intermediate level below the upper level, above the lower level, and situated slightly above a stack of maximum height supported on the platform with the platform at the lower level. In accordance with the invention a walkway is vertically displaceable on the frame immediately downstream of the stacking station between an upper position generally at the upper level and a lower position at the intermediate level. The platform is engageable underneath the walkway for raising the walkway from the intermediate level to the upper level on movement of the platform upward past the intermediate level to the upper level.

Thus with this system the walkway is never in the way, but is always positioned as low as possible. When the platform is all the way up, the walkway is also all the way up, out of harm's way. As the platform descends the walkway also descends, but it stops at a position where it could interfere with a stack being removed downstream from the stacking station. This makes it possible for a worker on the walkway, when the transverse profile of the sheets is different, to put wedges in the stack to keep its upper surface level. Similarly if there is a jam, the operator can easily work right from the walkway to clear it. Finally of course when format changes, the worker on the walkway is ideally positioned to make the necessary adjustments.

The frame according to the invention includes front posts flanking the station and rear posts also flanking the station and spaced downstream in the direction from the front posts. The walkway is supported on the rear posts. It is displaceable vertically through at least 100 mm and at most 500 mm.

The walkway in accordance with the invention is horizontally displaceable in the frame. In addition the apparatus has an element, e.g. a transverse backboard, displaceable in the direction to adjust for sheet length. A link is connected between the element and the walkway for joint displacement in the direction of the element and the walkway. Thus the walkway will always be positioned right against this element.

A rear walkway portion extends transversely of the direction and is fixed on the frame downstream in the direction from the walkway. The walkway is upwardly engageable with the rear portion on upward displacement by the platform so that this rear portion forms the upper stop delimiting the walkway's travel.

The walkway has a dimension measured in the direction greater than a distance between a stack of minimum length and the transverse walkway portion. Thus it will always fill the gap between the backboard or other element and the fixed rear walkway portion.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
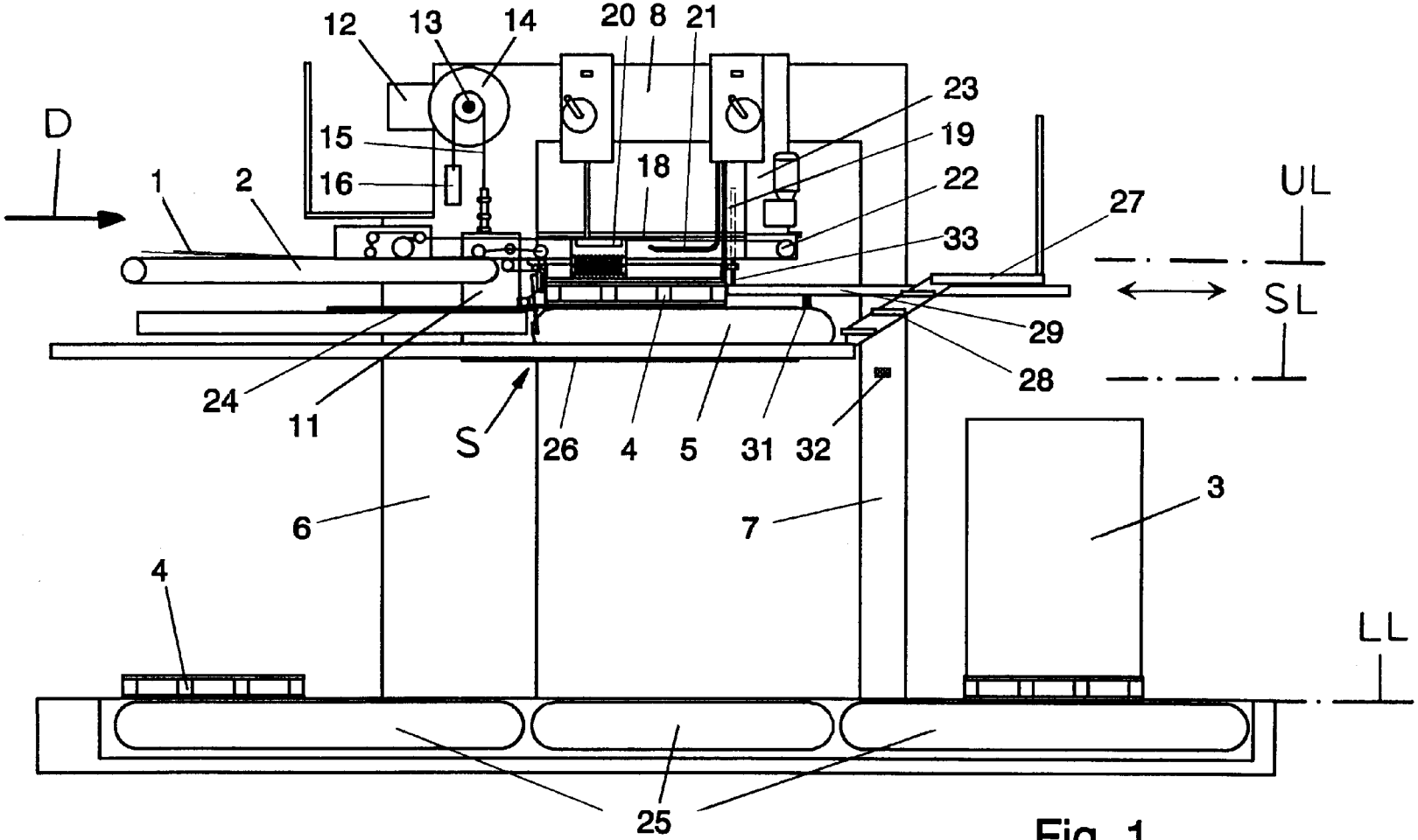
FIG. 1 is a small scale and partly diagrammatic side view illustrating the apparatus of the invention with the service walkway in the upper position.
Figure 2:
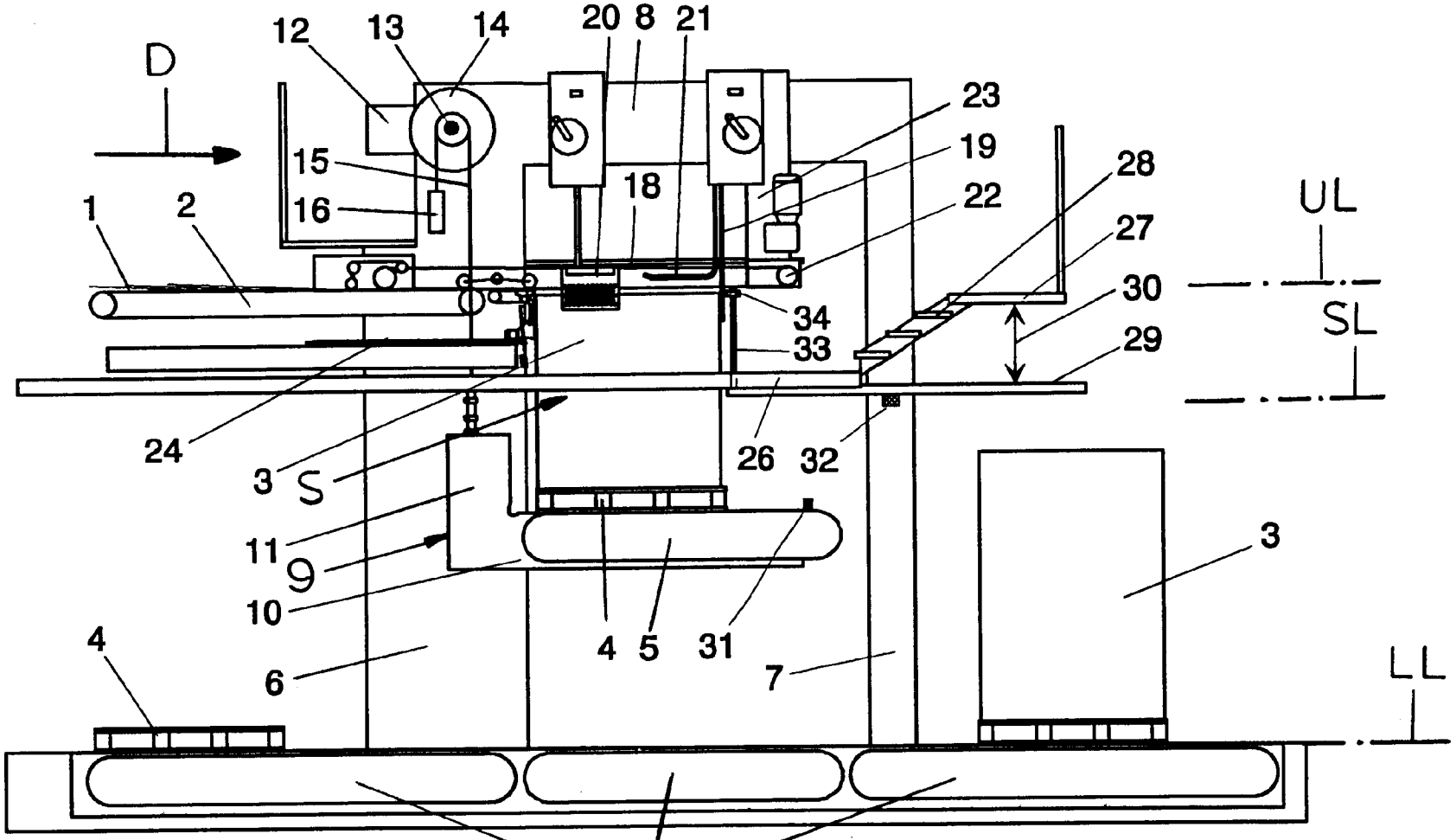
FIG. 2 shows the apparatus with the service walkway in the lower position.

As seen in FIG. 1 a succession of sheets 1 are delivered in overlapping condition to a stacking station S in a transport direction D by a conveyor 2 from an unillustrated crosswise slitter. The sheets 1 are gripped by upper conveyor belts 18 and separated by air currents from nozzles 21 so that they butt against end stop plates 19 and side shaker plates 20 to form a neat stack 3 atop a pallet 4 on a short platform conveyor 5. The conveyors 2 and other equipment are supported on a frame formed by upstream posts 6 flanking the conveyor 2, downstream posts 7, and horizontal beams 8 interconnecting upper ends of these posts 6 and 7. The stop plates 19 and downstream rollers 22 of the upper conveyor belts 2 are mounted on carriages 23 that are movable on the frame 6, 7, 8 to accommodate different sheet sizes. An intermediate platform 24 can be slid into place to catch the sheets 1 while a full pallet 4 is exchanged for an empty one.

The pallet 4 and conveyor 5 can be moved between a lower position in a plane LL level with a floor conveyor 25 and an upper position in a plane UL level with the input conveyor 2. To this end the conveyor 5 is mounted on horizontal arms 10 of a pair of massive L-shaped steel plates 9 lying in respective vertical planes flanking the stacking station S and having upper arms 11 slidable in unillustrated vertical guides fixed on the upstream posts 6. The plates 9 are some 40 mm thick and the arms 10 and 11 are some 400 mm wide so as to be very stiff and capable of supporting several tons.

The upper end of each arm 11 is fixed to an end of a cable or chain 15 that passes over a respective drive wheel 14 and which carries a counterweight 16 at its other end. A main drive motor 12 is connected through an unillustrated step-down transmission to a horizontal shaft 13 journaled in the upper ends of the posts 6 and carrying both of the wheels 14, so that the two plates 9 can be raised and lowered synchronously.

According to the invention a U-shaped walkway has a pair of lower longitudinally extending portions 26 and an upper transversely extending portion 27, all fixed to the frame 6, 7, 8. The upper portion 27 is located at or slightly below the upper level UL at which the sheets 1 are fed in, and the side portions 26 slightly above an intermediate level SL which is slightly above the top of the tallest possible stack 3 that could be formed by the machine. A short stairway 28 connects the rear or downstream end of each of the portions 26 to the respective end of the portion 27.

A second transverse walkway 29 is vertically displaceably guided on the posts 7 for movement through a vertical stroke 30 of at least 100 mm and extends from a front edge immediately behind the backboard 19 to a rear edge that is normally underneath or downstream of the first transverse walkway portion 27. Thus the dimension of this walkway 29 in the direction D is greater than the maximum horizontal distance parallel to the direction D between the backboard 29 when it is set for the shortest possible stack and the front edge of the walkway portion 27. The upper end of the vertical travel of the always horizontal walkway 29 is defined by the bottom surface of the walkway portion 27, and the lower end of the vertical travel is set by abutments or stops 32 fixed on the posts 7 at the level SL. The platform 5 carries bumpers 31 that engage underneath the walkway 29 and raise it into the uppermost position of FIG. 1 when this platform 5 is in its uppermost position. When, however, the platform 5 drops, the walkway 29 also moves down until it engages the stops 32, whereupon it stops generally at the intermediate level SL and allows the platform 5 to continue descending on its own. In this manner any contact between the walkway and the stack-forming and -guiding elements is impossible.

With this system it is therefore easy for a person to stand on the walkway while the apparatus is working and, for instance, insert wedges into the stack 3. This person will be working in complete safety but will in no way interfere with operation of the stacking machine. When the finished stack 3 is moved out in the direction D, it will have clearance under the walkway 29 due to the placement of the stops 32. Normally the vertical stroke 30 of the walkway or platform 29 can be as much as 500 mm, here it is 400 mm. No separate drive is provided to move it, as the weight of this equipment and the operator on it is negligible compared to the weight of the stack 3.

The walkway 29 is also horizontally movable in direction D relative to the frame 6, 7, 8. To this end it carries at its front end one or more vertically extending pins or rods 33 that engage through eyes 34 mounted on the rear of the backboard 19. Thus, no matter what the position of this backboard 19, the walkway 29 will extend right to it. The vertical length of the rods exceeds the stroke 30 so that this linkage never comes apart. To this end the walkway is normally supported at its side in unillustrated carriages that can travel vertically in the rear posts 7, and can itself slide horizontally in these carriages.

Clearly as safety requires, the walkway 20 can be provided with railings, footboards, and the like. A roll-down partition like a garage door can be provided between the rear walkway portion 27 and the walkway 29 for protection in this direction, preventing anything from getting between these elements and being crushed when the walkway 29 is raised to its uppermost FIG. 1 position.

I claim:

1. An apparatus for stacking sheets, the apparatus comprising:

a frame defining a stacking station;

conveyor means for delivering the sheets continuously one after the other at a predetermined upper level in a transport direction to the station;

a platform vertically displaceable in the stacking station between the upper level and a lower level below the upper level, the platform being adapted to hold a stack of a predetermined maximum height;

drive means for displacing the platform vertically;

stops on the frame at an intermediate level, the intermediate level being below the upper level, above the lower level, and situated slightly above a stack of the maximum height supported on the platform with the platform at the lower level;

a walkway vertically displaceable on the frame immediately downstream of the stacking station between an upper position generally at the upper level and a lower position at the intermediate level; and means coupling the platform to the walkway for raising the walkway from the intermediate level to the upper level on movement of the platform upward past the intermediate level to the upper level.

2. The sheet-stacking apparatus defined in claim 1 wherein the frame includes front posts flanking the station and rear posts also flanking the station and spaced downstream in the transport direction from the front posts, the walkway being supported on the rear posts.

3. The sheet-stacking apparatus defined in claim 1 wherein the walkway is displaceable vertically through at least 100 mm.

4. The sheet-stacking apparatus defined in claim 3 wherein the walkway is displaceable vertically through at most 500 mm.

5. The sheet-stacking apparatus defined in claim 1 wherein the walkway is horizontally displaceable in the frame.

6. The sheet-stacking apparatus defined in claim 5, further comprising:

an element displaceable in the transport direction to adjust for sheet length; and link means connected between the element and the walkway for joint displacement in the transport direction of the element and the walkway.

7. The sheet-stacking apparatus defined in claim 1, further comprising:

a rear walkway portion extending transversely of the transport direction and fixed on the frame downstream in the transport direction from the walkway, the walkway being upwardly engageable with the rear portion on upward displacement by the platform.

8. The sheet-stacking apparatus defined in claim 7 wherein the walkway has a dimension measured in the transport direction greater than a distance between a stack of minimum length and the transverse walkway portion.

* * * * *